US007878917B2

(12) United States Patent
Johnson et al.

(10) Patent No.: US 7,878,917 B2
(45) Date of Patent: Feb. 1, 2011

(54) GOLF CLUB GRIP ALIGNMENT USING LASER ALIGNING DEVICE

(75) Inventors: Lanny L. Johnson, Okemos, MI (US); Benny Chan, Fremont, CA (US); Suganda Jutamulia, Berkeley, CA (US); Chih Yen Liu, Saratoga, CA (US)

(73) Assignee: Newtonics Spectra Inc., Fremont, CA (US)

( * ) Notice: Subject to any disclaimer, the term of this patent is extended or adjusted under 35 U.S.C. 154(b) by 13 days.

(21) Appl. No.: 12/001,163

(22) Filed: Dec. 10, 2007

(65) Prior Publication Data

US 2009/0149267 A1 Jun. 11, 2009

(51) Int. Cl.
*A63B 69/36* (2006.01)

(52) U.S. Cl. ..... 473/220; 473/226

(58) Field of Classification Search ..... 473/219–226
See application file for complete search history.

(56) References Cited

U.S. PATENT DOCUMENTS 4,861,034 A * 8/1989 Lee ..... 473/202
5,207,429 A * 5/1993 Walmsley et al. ..... 473/220
5,870,815 A 2/1999 Karner et al.
5,897,441 A * 4/1999 Apthorp ..... 473/220
5,964,668 A * 10/1999 Tai et al. ..... 473/220
6,004,230 A * 12/1999 Hooker ..... 473/409
6,415,502 B1 7/2002 Gunshinan et al.
6,435,974 B1 * 8/2002 Chen ..... 473/220
6,488,592 B1 * 12/2002 Boatner ..... 473/220
6,605,005 B1 * 8/2003 Lin ..... 473/220
6,758,760 B1 * 7/2004 Kellogg et al. ..... 473/220
6,796,910 B1 * 9/2004 Foster ..... 473/220
6,877,201 B2 4/2005 Gunshinan et al.
6,921,340 B2 * 7/2005 Dickie ..... 473/220
7,118,488 B2 10/2006 Chan et al.

OTHER PUBLICATIONS

Edmund Optics On-line Catalog, www.edmundoptics.com (2007).

* cited by examiner

*Primary Examiner*—Nini Legesse
(74) *Attorney, Agent, or Firm*—Suganda Jutamulia

(57) ABSTRACT

A laser aligning device is mounted on the flat side of a putter grip or other cylindrically asymmetric surface of a club grip and emits a fan shaped light sheet. The light sheet is perpendicular to the flat side of the putter grip. The light sheet projects a visible laser line on a plane such as the ground when the head is on the same plane. The alignment of the grip relative to the putter head's face can be inspected by visually inspecting the orientation of the projected line on the plane relative to the head's face. The grip can be adjusted and fixed so that it is properly oriented to the face.

9 Claims, 10 Drawing Sheets

GOLF CLUB GRIP ALIGNMENT USING LASER ALIGNING DEVICE

CROSS-REFERENCE TO RELATED APPLICATIONS

Reference is made to our U.S. Pat. No. 7,188,488, issued Oct. 10, 2006 on a putter aligning device.

BACKGROUND

1. Field

This field is golf, specifically golf club grip alignment

2. Prior Art

Most golf clubs have a hand grip for ease of holding the club. Some grips are not perfectly cylindrical (circular cross-section), because they may have an oval cross-section or they may include a flat designed to assist the golfer in aligning the club with the golf ball to be hit. For example, an iron club has an oval-shaped grip, a putter has a grip with one flat side, and some clubs have raised or grooved patterns, dimples, or other relief on their grips. All these non-cylindrical structures provide tactile feedback in order to assist and assure the golfer's consistent and proper grip on the club. Such non-cylindrical grip designs create a need for reliable and uniform means of aligning the grip to the golf club's face during the installation of the grip, and for reliable and simple means of verifying alignment after the installation.

Most grips are a sleeve of rubber that is permanently attached to the shaft. It cannot be easily twisted after it is installed. However, the manufacturer or installer may imperfectly install the grip, so that the golfer cannot use the club properly. Even worst, the golfer may develop an incorrect way in using a golf club.

To assist the installer in aligning the grips, many grips have small alignment marks on the side of the grip facing upward when the club is held horizontally. The grip is aligned with the face of the golf club head, which contacts the golf ball when the golfer hits the ball. Since the alignment marks and the club head are quite a distance apart, misalignment during grip installation can and often does occur if the alignment is based on visual inspection.

Recognizing the limitation of visually aligning the face of the golf club head with the grip alignment marks, various devices to assist in the grip installation process have been proposed. U.S. Pat. No. 5,870,815 to Kamer at al. (Feb. 16, 1999), U.S. Pat. No. 6,415,502 to Gunshinan et al. (Jul. 9, 2002), and U.S. Pat. No. 6,877,201 to Gunshinan et al. (Apr. 12, 2005) disclose mechanical fixtures that can rotate the club head about the shaft axis until the club head is in a correct or desired position. After the golf club is in the correct position, it is ready to receive a grip in a desired, pre-selected position and alignment. A laser line projected by a laser device is superimposed along the shaft axis and passes through the desired position of the grip alignment mark. The installer then aligns the grip alignment mark along the visual laser line. However they use bulky mechanical stations and suffer from the following disadvantages:

(a) the alignment station is not portable, (b) the alignment station is expensive, and (c) the alignment station is designed for use by manufacturers and is not for personal use.

SUMMARY

In accordance with one embodiment, a laser alignment device is mounted on the grip of a golf club while the golf club head is on the ground. The laser projects a line on the ground. When the grip is rotated about the axis of the shaft, the projected line on the ground rotates accordingly. Thus the orientation of the grip relative to the golf club head is clearly shown by the orientation of the line on the ground relative to the club head.

DRAWINGS—FIGURES

In the drawings, closely related figures have the same number but different alphabetic suffixes.

FIG. 1A' is a cross-sectional view of the club taken along the line 1A'-1A' of FIG. 1A, FIGS. 1B and 1C show club grips having a flat and an oval cross-section for use with the club of FIG. 1A.

DETAILED DESCRIPTION—FIGS. 1A, 1B, AND 1C

Figure 1A:
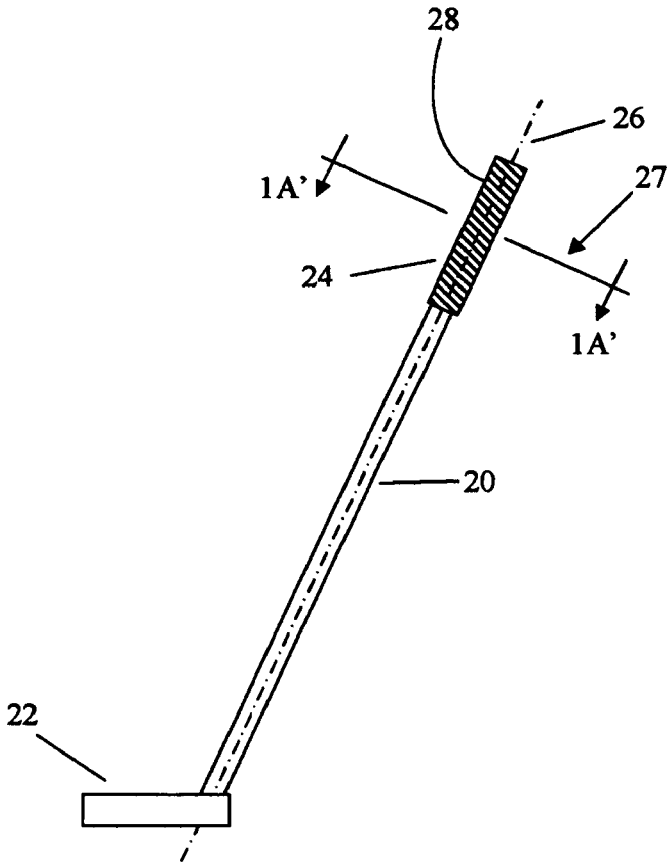
FIG. 1A shows a golf club according to one embodiment.
Figure 1A:
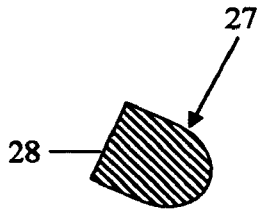
Figure 1B:
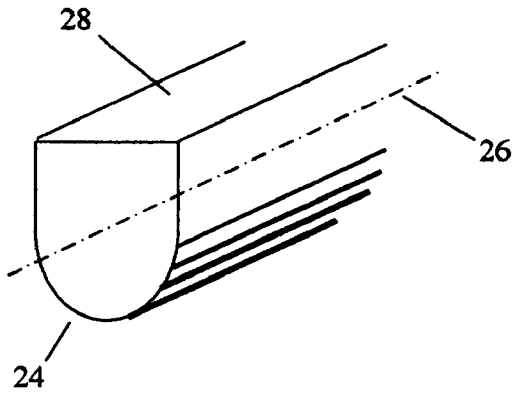
Figure 1C:
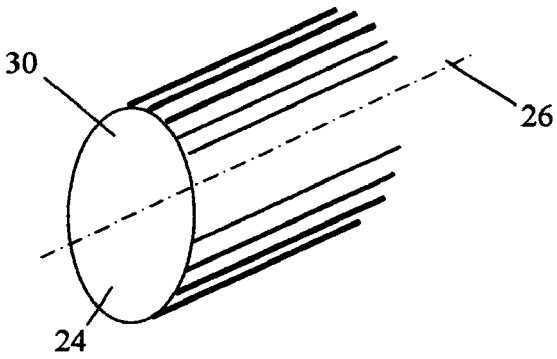

FIG. 1A shows golf club (preferably a putter) comprises a shaft 20, a club head 22 connected to shaft 20, and a grip 24 mounted on shaft 20. At the grip end, shaft 20 is cylindrical (i.e., it has a circular cross-section) and has a shaft axis 26. As shown in FIG. 1A', the grip's cross-section 27 of a putter has a flat side 28. Flat surface 28 of FIGS. 1A and 1A' is perpendicular to the plane of paper. The face of club head 22 is parallel to the plane of the paper in FIG. 1A. Thus surface 28 is perpendicular to the face of club head 22 (ball-hitting surface). FIG. 1B shows more detail of the grip portion of the club. In other golf clubs, grip 24 may have an oval cross-section 30 as shown in FIG. 1C. The alignment of oval-shaped grip will be discussed later.

Figure 2A:
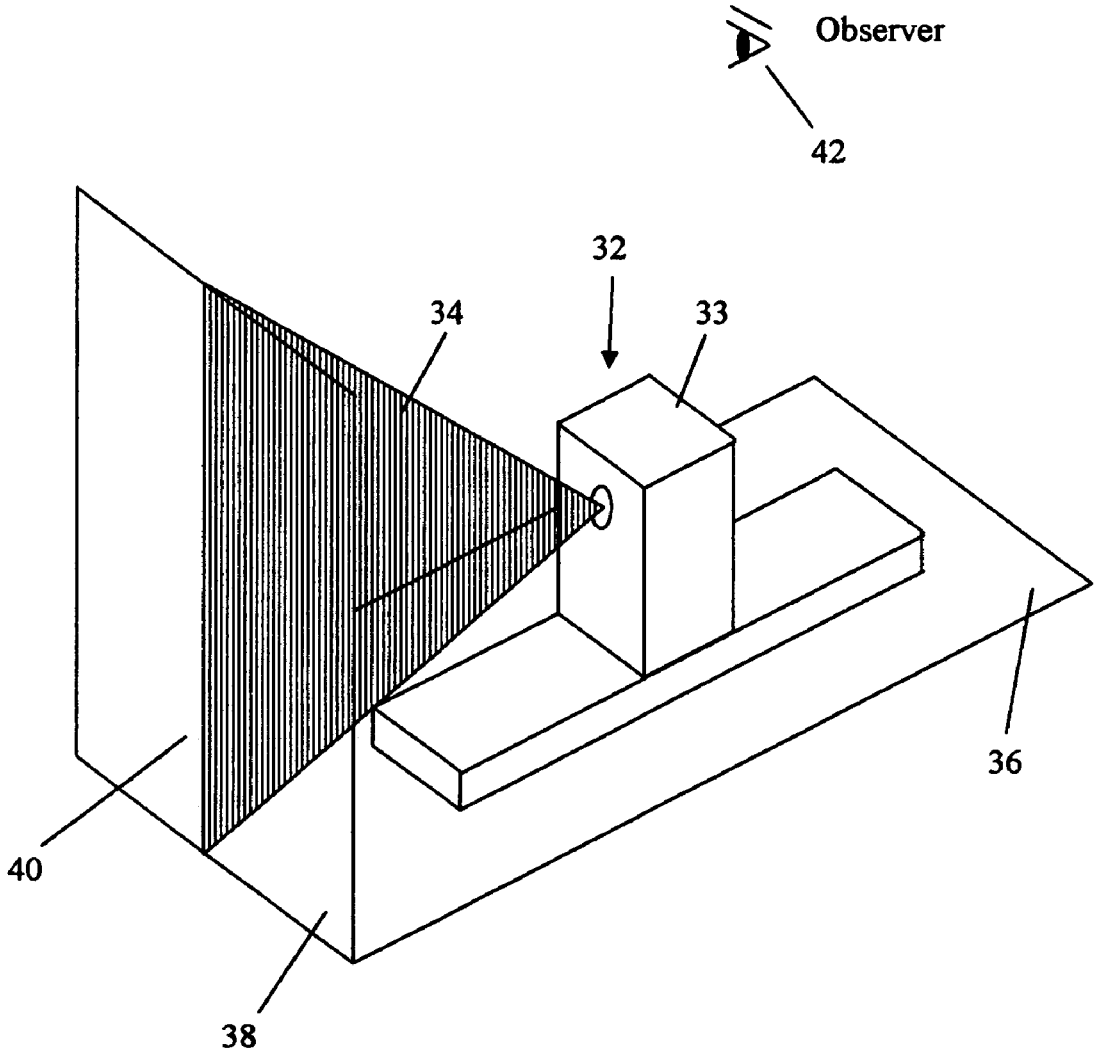
FIGS. 2A and 2B show a laser aligning device positioned on a horizontal plane emitting a fan shape light sheet for use in aligning the grip on the club, with FIG. 2A showing a vertical target plane and FIG. 2B showing a tilted target plane.
Figure 2B:
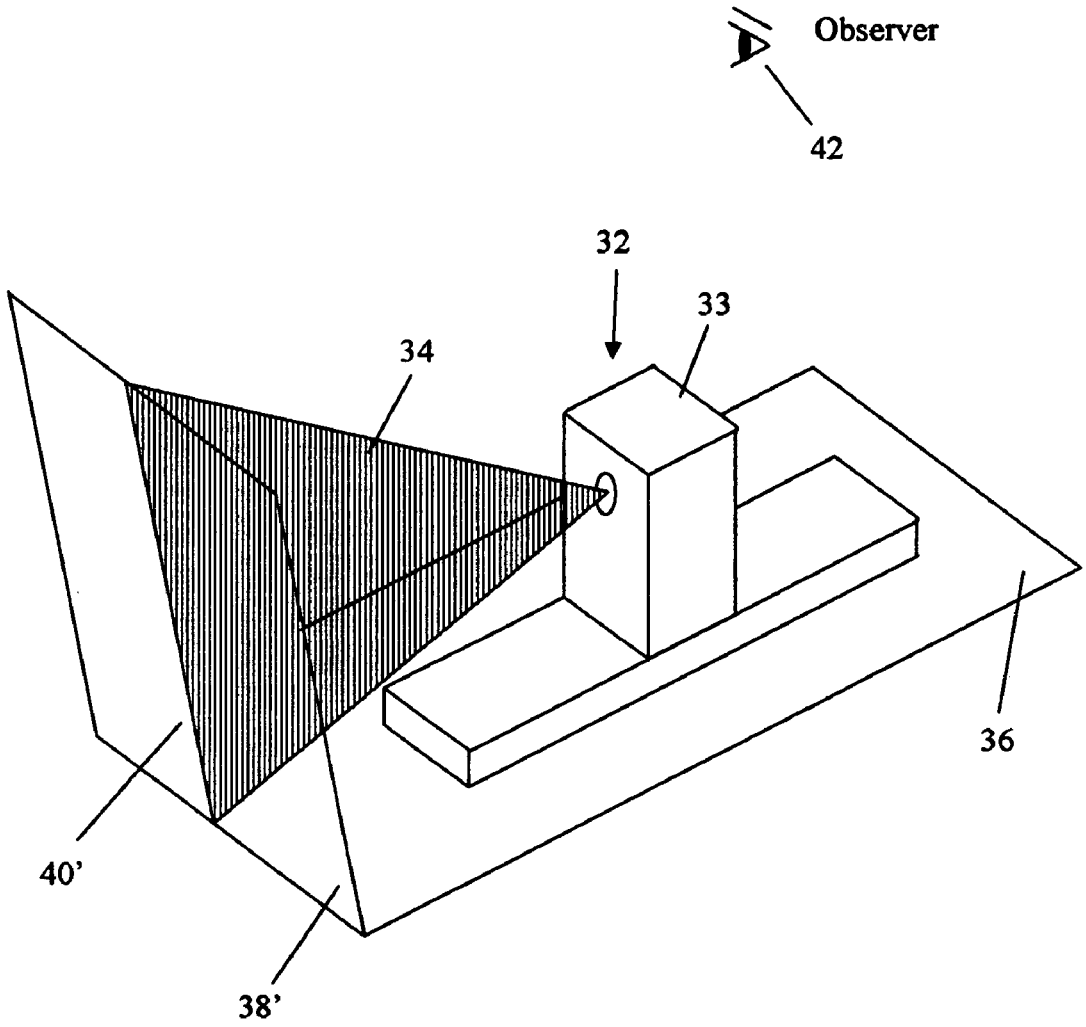

DETAILED DESCRIPTION—FIGS. 2A and 2B

FIGS. 2A and 2B are diagrammatic views which illustrate some principles and geometry of laser aligning. A laser aligner 32 is positioned on a horizontal plane 36. Aligner 32 has a light emitting unit 33, which comprises a laser diode (not shown) energized by batteries (not shown) and an on-off switch (not shown). The laser diode emits a laser beam (not shown) inside unit 33. Unit 33 contains optics (not shown), which shape the beam to form a fan-shaped light sheet 34 emitted from unit 33. The optics can be a combination of a collimating lens and a cylindrical lens, a specially designed anamorphic lens, or a diffractive optical element. Unit 33 is similar to devices generally known as laser line generators, which are commercially available. For example, a laser diode module set (C59-464 and C59-469) from Edmund Optics, New Jersey (www.edmundoptics.com) emits a line with 75-degree fan angle.

Light sheet 34 intersects vertical plane 38 at line 40. Plane 38 scatters light sheet 34, forming a laser line 40, which is visible to an observer 42. Observer 42 cannot usually see light sheet 34 but can see line 40 because it represents incident light from sheet 34 reflected from surface 38.

As shown in FIG. 2B, when vertical plane 38 is tilted so that its top moves away from unit 33, light sheet 34 intersects titled plane 38' at line 40'. Observer 42 will see tilted line 40'.

DETAILED DESCRIPTION—FIGS. 3, 4, AND 5—PREFERRED EMBODIMENT

Figure 3:
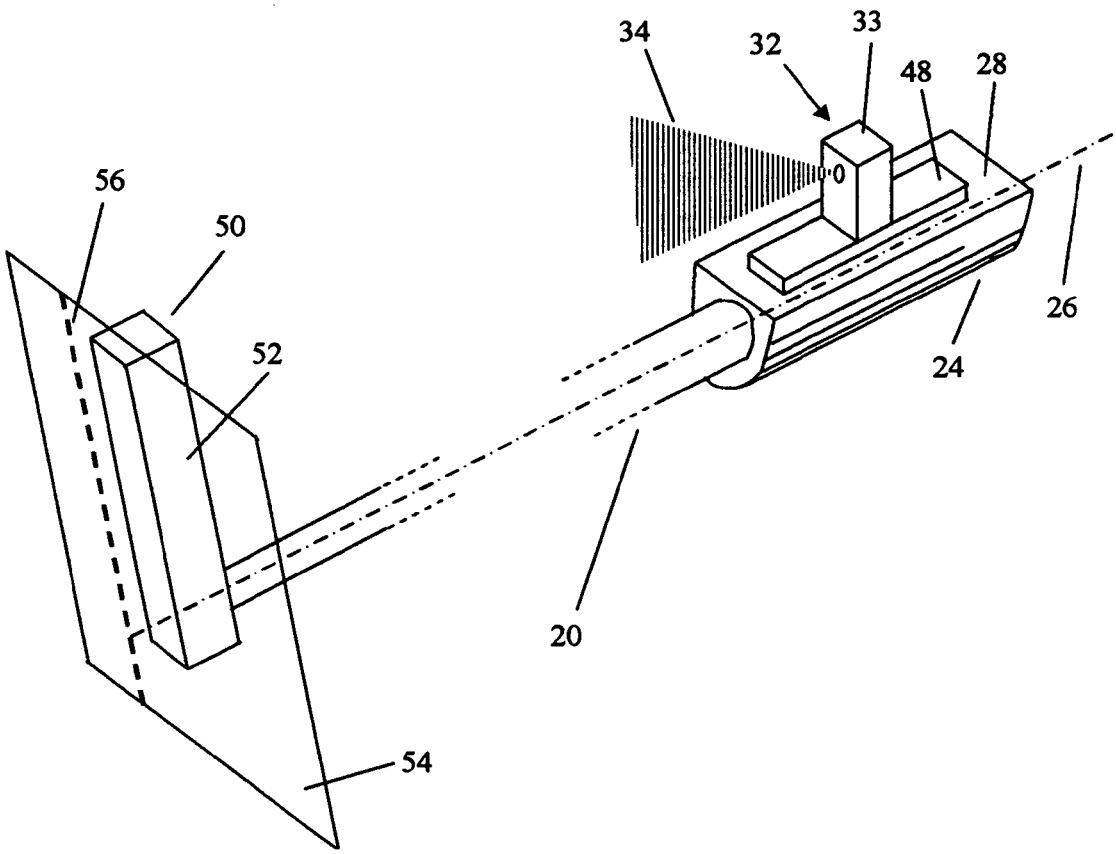
FIGS. 3 and 4 show the laser aligning device mounted on the flat surface of the grip of a putter with the laser emitted light sheet coplanar and not coplanar with the shaft of the putter.
Figure 4:
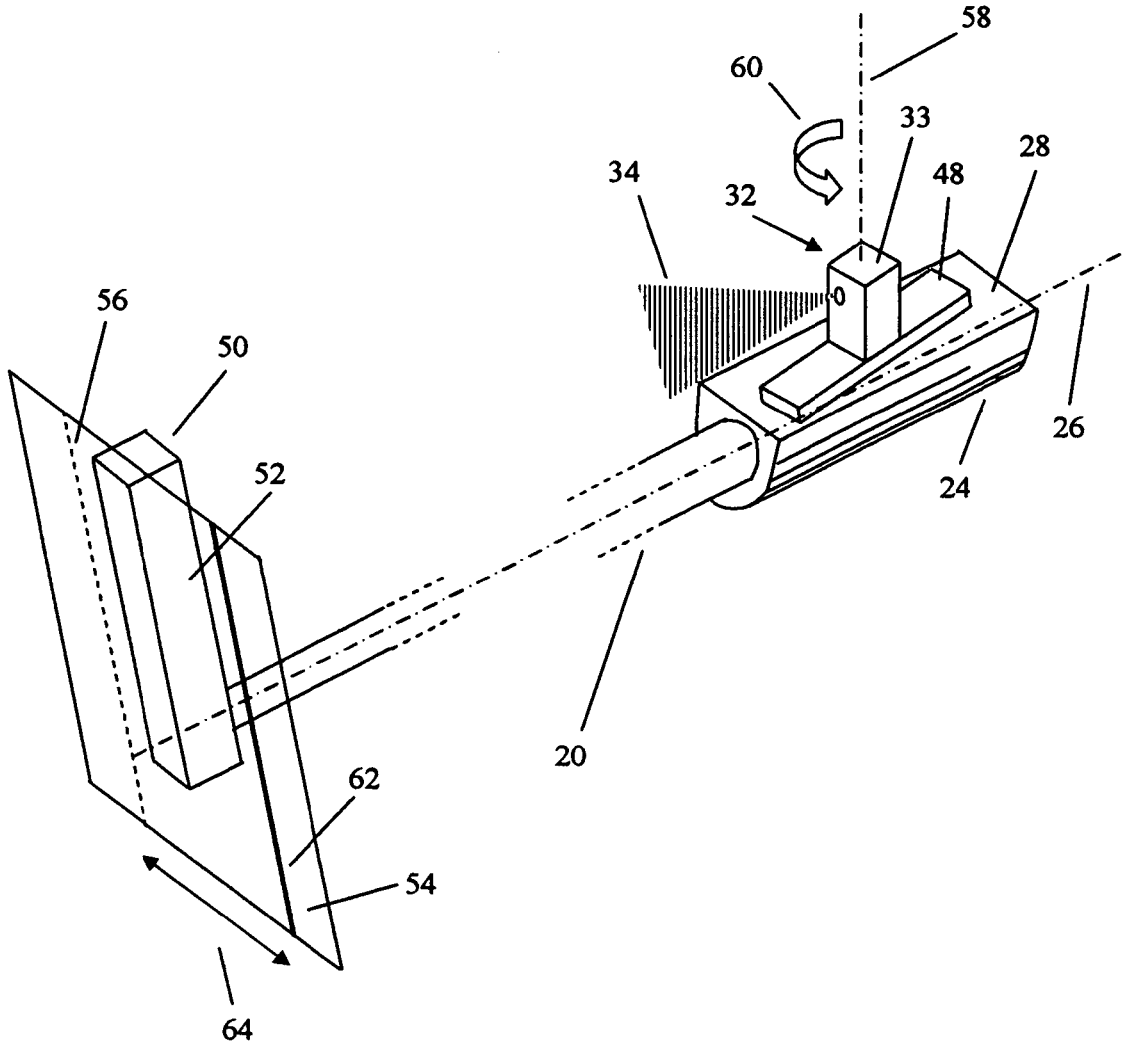
Figure 5:
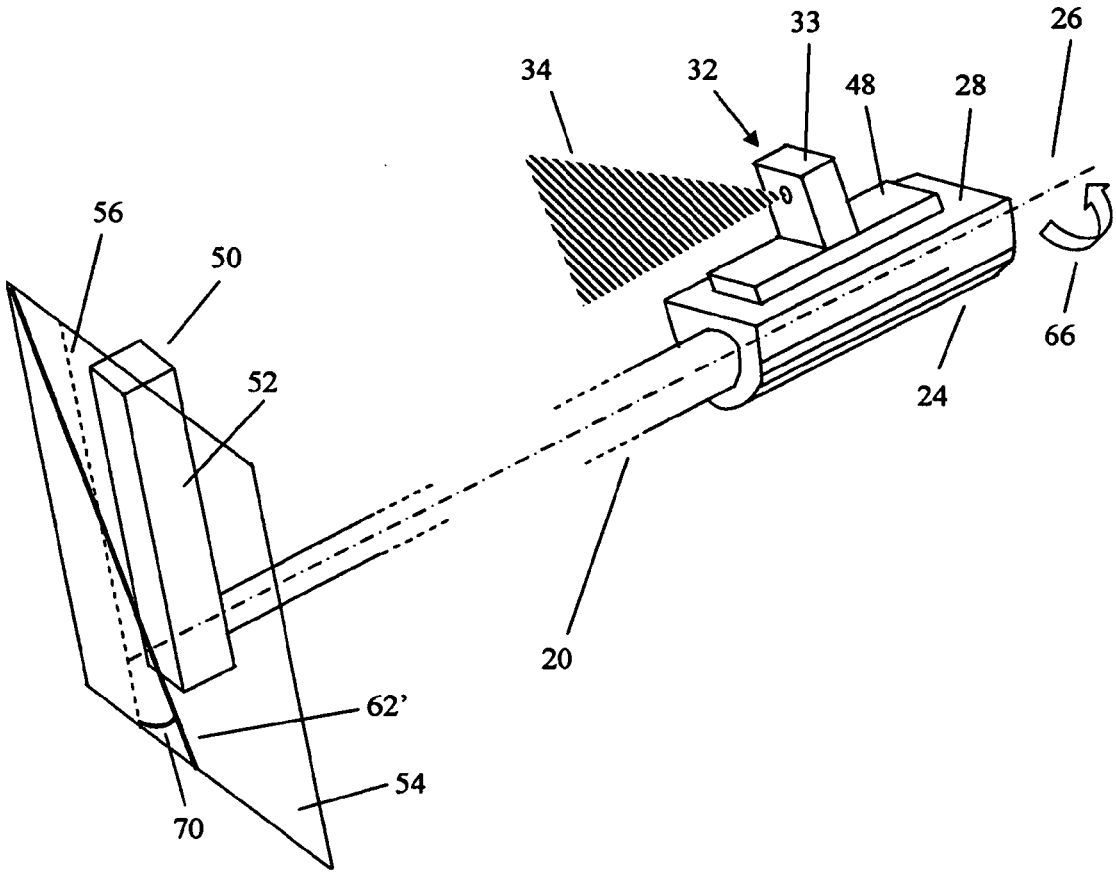
FIG. 5 is similar to FIGS. 3 and 4 with the grip incorrectly aligned.

One embodiment of the aligning device for a putter employing the principles of FIGS. 2A and 2B is illustrated in FIGS. 3, 4, and 5. The grip of a putter has a flat side as shown in FIG. 1B, which must be held generally vertical and aligned to be perpendicular to the generally vertical face of the putter head. Referring back to FIG. 1A, when the grip is properly aligned, the flat side of the grip is perpendicular to the plane of paper and the face of the putter head coplanar with the paper. Thus the flat side of the grip is perpendicular to the face of the putter head.

Laser aligner 32 (FIG. 3) has a flat base 48 that supports light emitting unit 33. Aligner 32 is mounted on grip 24 by mounting means such as straps (not shown) so that the bottom of flat base 48 butts against and is in close contact with flat side 28 of grip 24. Light sheet 34 is pre-aligned to be perpendicular to base 48 and surface 28. Grip 24 is installed on shaft 20. Shaft 20 connects to putter head 50. Head 50 has a face 52 for hitting a golf ball (not shown).

Surface 28 of the grip must be perpendicular to face 52 of the putter head. If the putter grip is improperly installed, even it is off only a few degrees, the putter will be gripped in an open or closed stance and the golfer may not even be aware of such a condition.

There are three types of stances in golf: square, closed, and open. When a right-handed golfer positions their feet parallel to the line of flight which is the imaginary line between the ball and the target; the square stance is that in which both feet are equally distanced from the line of flight. This is the basic standard stance, which is recommended for overall compactness and control. The closed stance has left foot nearer than the right foot to the line of flight The open stance has the left foot drawn back farther away from the line of flight than the right foot.

Figure 7:
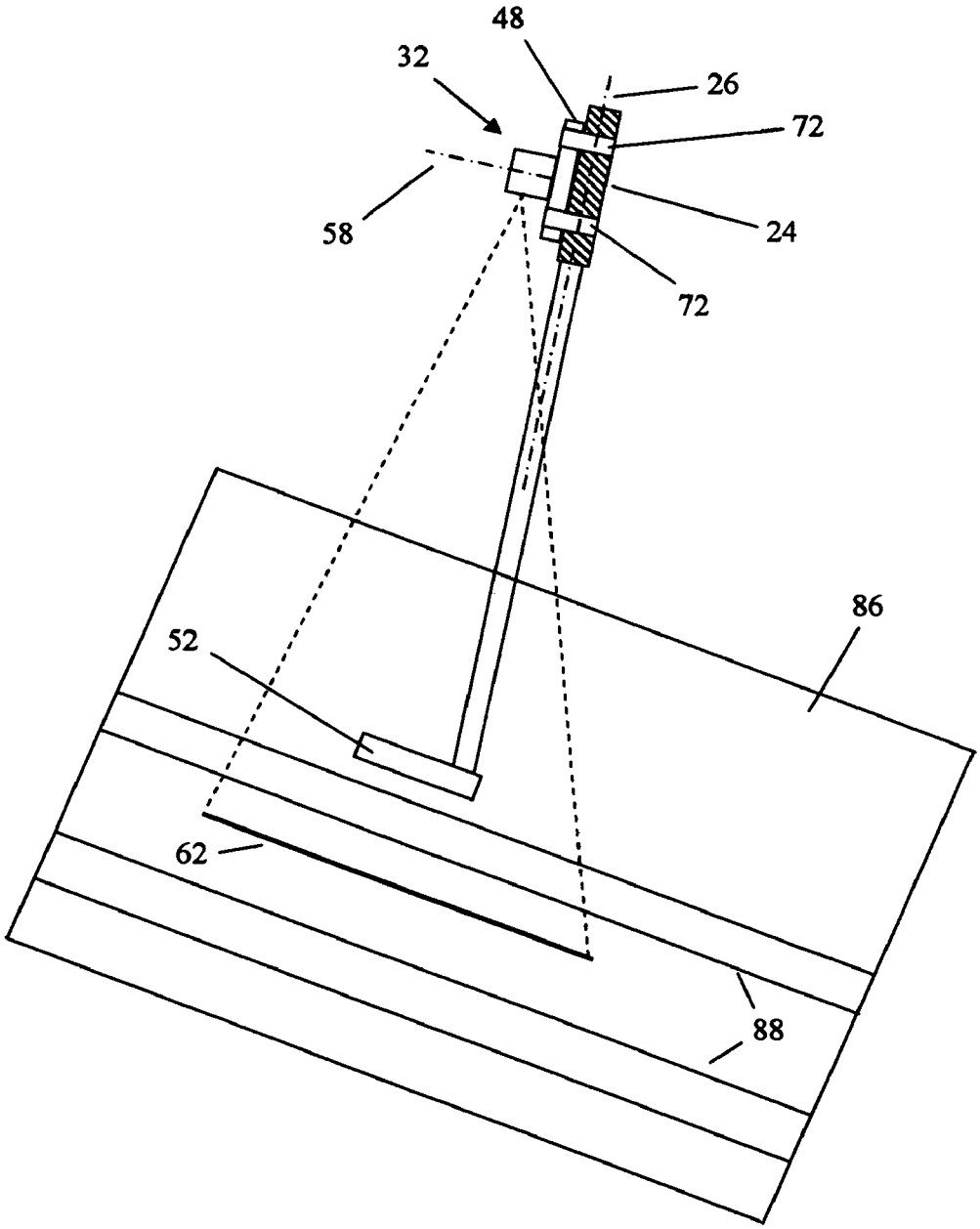
FIG. 7 illustrates the laser aligning device and the geometry for aligning the grip to the putter head's face.

When grip 24 is properly oriented, flat surface 28 of grip 24 will be perpendicular to the putter's face 52. Light sheet 34 is perpendicular to the grip's flat surface 28, and thus parallel to face 52. Putter head 50 is placed on plane 54 (which could be ground as shown later in FIG. 7). Since flat surface 28 is a plane equivalent to plane 36 in FIG. 2B, plane 54 of FIG. 3 is equivalent to tilted plane 38' in FIG. 2B. Light sheet 34 intersects plane 54 at line 56, which is parallel to face 52. Light sheet 34 is coplanar with shaft axis 26.

If aligner 32 is rotated about the aligner's axis 58 (FIG. 4), which is perpendicular to flat surface 28, by rotation angle 60, while grip 24 is still in proper orientation, light sheet 34 intersects plane 54 at line 62, which is still parallel to putter head's face 52, but moved from line 56 by distance 64. Since line 62 is a laser line, it is highly visible to an operator (not shown).

If both aligner 32 and grip 24 are together rotated about shaft axis 26 by angle 66 (FIG. 5), light sheet 34 intersects plane 54 at line 62'. Line 62' forms angle 70 with line 56 or face 52. Angle 70 has the same magnitude as angle 66.

When the grip installer visually inspects the orientation of visible laser line 62 relative to face 52 of the putter head on plane 54, which can be simply the ground, the grip can be aligned to the proper or desired orientation. The installer does this by twisting grip 24 on shaft 20 and rechecking until line 62 and face 52 are aligned. The orientation of line 62 relative to face 52 indicates the alignment of grip 24 relative to face 52 of the putter head.

DETAILED DESCRIPTION—FIG. 6—PREFERRED EMBODIMENT

Figure 6:
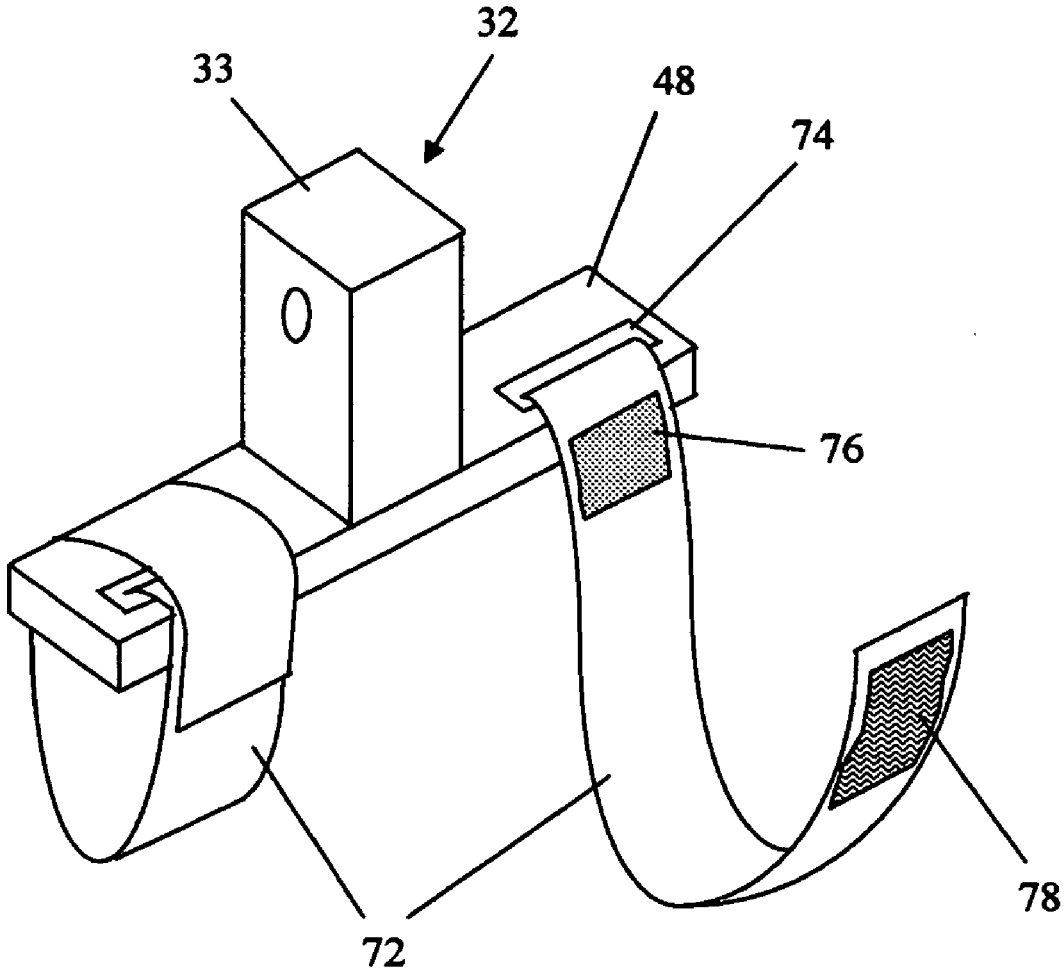
FIG. 6 shows the laser aligning device and elastic bands with hook-and-loop tapes for mounting the device on the grip.

FIG. 6 shows one embodiment of a mounting means for mounting aligner 32 on the putter grip (not shown). Aligner 32 comprises a flat base 48, which must be in contact with the flat surface of the putter grip. Therefore, base 48 must be tightly held to the grip. Various mounting means are possible. One embodiment can use elastic strips or bands 72 to mount aligner 32 to the grip. Elastic bands 72 tightly wrap two sides of flat base 48 around the grip (not shown). For illustration, the left band is in a closed position, and the right band is in open position. One end of elastic band 72 is permanently attached to base 48. For example, an end of band 72 goes through hole 74 in base 48, flips over and is sewed or glued to the main part of band 72, such that an end of band 72 is permanently attached to base 48, and another end of band 72 is free. Alternatively, elastic band 72 passes two holes (not shown) in base 48, and both ends of band 72 are free. A part of hook-and-loop tape 76 is permanently attached to band 72, and another mating part of hook-and-loop tape 78 is permanently attached to the opposite side of band 72, such that when band 72 is in closed position, the mating parts of the hook-and-loop tape face each other.

To attach aligner 32 to the grip of the putter or other club, base 48 is placed or butted against flat surface 28 (FIG. 5) of the grip, and bands 72 are wrapped tightly around the grip, and hook-and-loop portions 78 and 76 are pressed together. Then the grip is aligned as explained below.

OPERATION—FIG. 7

The manner of using the laser aligning device (aligner) to align the grip or test the alignment of grip is as follows. As stated, an operator mounts aligner 32 on grip 24 (FIG. 7) by butting flat base 48 of aligner 32 against the flat surface of grip 24. Aligner 32 is tightly held by elastic bands 72. The putter is placed on the ground and the aligner is turned on so that line 62 is projected onto the ground.

To visually inspect the orientation of line 62 relative to face 52, aligner 32 is fine-rotated about device axis 58, such that line 62 is not blocked by the putter head, and is in the proximity to face 52. The orientation of line 62 relative to face 52 indicates the alignment of grip 24 relative to face 52. This can be done by any golfer who wants to test the grip-face alignment of his or her putter. Although the golfer cannot change the alignment, he or she can test the alignment. If the alignment is incorrect, the golfer may take his or her putter to a golf club shop to correct the grip alignment.

To install the grip correctly in factory, the operator may rotate or twist grip 24 about shaft axis 26 until visible laser line 62 on the ground or a screen is parallel to face 52, when the putter head is placed on the ground or a mechanical station.

Additionally, the putter head can be placed on a board 86 or paper with printed parallel lines 88. The putter head's face is first aligned so it is parallel to the lines on the board. Then the alignment of the laser line on the board can be easily inspected by comparing it with the parallel lines on the board.

Figure 8A:
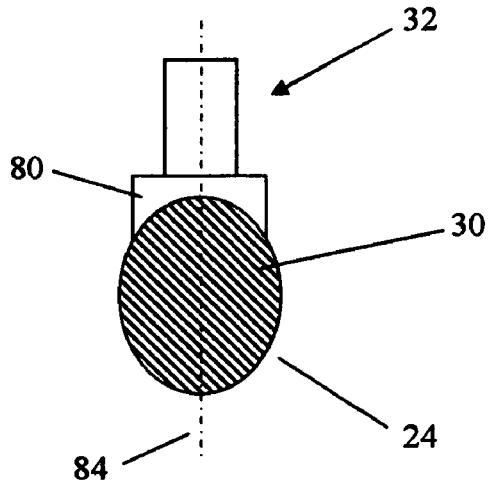
FIGS. 8A and 8B show additional designs of the base of aligning device for grip having oval cross-section.
Figure 8B:
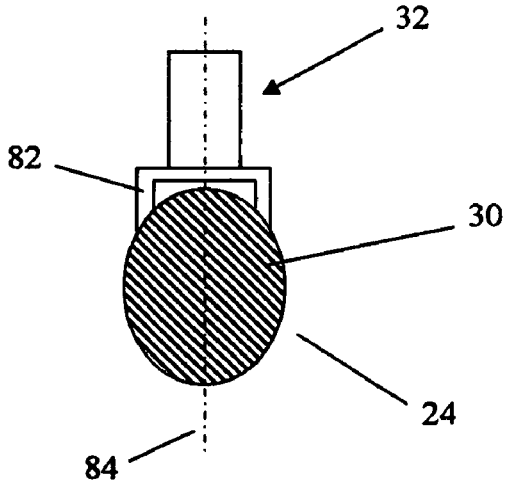

DETAILED DESCRIPTION—FIGS. 8A and 8B—ADDITIONAL EMBODIMENTS

For a golf club grip 24 (FIG. 8A) having oval cross-section 30 instead of a flat side, the bottom side of base 80 of aligner 32 can be designed to match the oval shape, so base 80 can be properly placed on grip 24. The light sheet (not shown) emitted from aligner 32 is coplanar with long axis 84 of oval-shaped cross-section 30 of grip 24. In fact, various designs are possible, including one that may match universal oval-shaped cross-sections using base 82, which comprises two symmetric supports centered at long axis 84 as illustrated in FIG. 8B. Base 82 may have a center mark (not shown), which can be aligned with the alignment mark (not shown) of the grip. Thus the principle disclosed above can be applied to grips, which have no flat surface.

Advantages

From the description above, a number of advantages of some embodiments of our laser aligning device become evident:

(a) The device provides an objective method to verify the grip-face alignment, either in the factory or by the golfer—a user.

(b) The device is compact, light weight, battery operated, and portable.

(c) The device can be easily mounted on and removed from a golf club grip.

(d) The device is easy to operate without using any mechanical station and tools.

(e) A touring professional golfer can bring the device along with him or her, and test the grip alignment of any club during the trip.

(f) A regular golfer can also use the device to test the grip alignment to prevent open or closed stance.

(g) The device can be used on a PGA (Professional Golfers' Association) mobile club-fitting trailer.

(h) A grip installer can use the device to test grip alignment during the alignment process that may use some mechanical tools. The laser line projected by the device on a plane in the proximity of the putter head's face shows the orientation of the grip. Thus it can be used for judging the grip orientation relative to the putting face. In contrast, laser line used in prior art devices is simply a visual line superimposed on the shaft axis, which has nothing to do with the grip orientation.

CONCLUSION, RAMIFICATIONS, AND SCOPE

Accordingly, the reader will see that the laser aligning device of the various embodiments can be used to test the alignment of a golf club grip relative to the club head's face without using bulky mechanical fixtures. The laser line projected on a plane in the proximity of the face of the club head shows the orientation of the grip. Therefore the grip can be aligned by rotating it until the projected laser line is at a desired orientation relative to the face of the club head. Further more embodiments of the laser aligning device has the additional advantages in that it permits the alignment at any desired orientation, i.e., the angle formed by the laser line and the face of a golf club can be at any angle (0°-360°);

it allows the alignment even the grip has no flat, i.e., the bottom side of the base of the aligning device can be designed to match the grip shape;

it provides the alignment not only for putter but also various golf clubs;

it provides an inexpensive production of the device, since the device comprises simply a laser diode, line generating optics, and batteries.

Although the description above contains many specificities of various aspects, these should not be construed as limiting the scope of the embodiment but as merely providing illustrations of some of the presently preferred embodiments. For example, the laser aligning device can be held by various mechanical clamps; the aligning device can be wrapped by rubber bands, non-elastic hook-and-loop bands, hook-and-loop bands having elastic and non-elastic parts, or other types of bands; the laser can be of any types of laser; the laser can be replaced by other light sources such as LED (light emitting diode), etc. Although shown on putter, the laser aligning device can be used on other clubs.

Thus the scope of the embodiment should be determined by the following claims and their legal equivalents, rather than by the examples given.

The invention claimed is:

1. An apparatus for inspecting and facilitating the alignment of a grip of a putter with a face of a head of said putter, comprising (a) a putter with a flat side grip;

(b) a light emitting unit for emitting a fan-shaped light sheet using light shaping optics, said unit being mounted on said grip so that said light sheet projects a visible line on a plane, when said head of said putter is on said plane;

(c) a flat base for supporting said unit, said flat base being arranged so that when said flat base is butted against a flat side of said grip of said putter, said light sheet is perpendicular to said side of said grip and an orientation of said projected line on said plane relative to said face of said head indicates an alignment of said grip relative to said face of said head;

and (d) mounting means for mounting said unit on said grip of said putter.

2. The apparatus of claim 1 wherein said plane is the ground.

3. The apparatus of claim 1 wherein said plane is a board with printed parallel lines.

4. The apparatus of claim 1 wherein said mounting means is selected from the group consisting of elastic bands, hook-and-loop tapes, and the combination of both.

5. The apparatus of claim 1 wherein said light emitting unit comprises a laser diode, batteries, a switch, and light shaping optics for forming said fan-shaped light sheet.

6. A method of aligning an asymmetrical part of a grip of a golf club with a face of a head of said club, comprising:

providing a golf club having a shaft with a head at one end of said shaft and a grip at the opposite end of said shaft, said face being oriented in a given direction normal to said shaft, said grip having an asymmetric or noncircular orientation-indicating portion that is oriented in a given direction normal to said shaft, said orientation-indicating portion being adjustably rotatable about said shaft and fixable in any position within a given range of positions;

providing a light-emitting unit on said grip, said light-emitting unit being arranged to emit a fan-shaped light sheet toward said head on the ground or a floor so that when said club is held so that said shaft extends upward from said ground or floor, said fan-shaped light sheet will form a line on said ground or floor that is generally parallel to said face of said head;

holding said club so that said shaft extends upward from said ground or floor and said light-emitting unit forms said line on said ground or floor that is generally parallel to said face of said head;

adjusting the orientation of said orientation-indicating portion so that said line on said ground or floor is truly or more precisely parallel to said face of said head; and fixing said orientation-indicating portion in said truly or more precisely parallel orientation.

7. The method of claim 6 wherein said light-emitting unit has a base being arranged to conformingly mate with said grip.

8. The method of claim 6 wherein said light-emitting unit has a flat base being butted against a flat side of said grip.

9. An apparatus for inspecting and facilitating the alignment of a grip of a golf club with a face of a head of said club, comprising (a) a club with a flat side grip;

(b) a light emitting unit for emitting a fan-shaped light sheet using light shaping optics, said unit being mounted on said grip so that said light sheet projects a visible line on a plane, when said head of said club is on said plane;

(c) a flat base for supporting said unit, said flat base being arranged so that when said flat base is butted against a flat side of said grip of said club, said light sheet is perpendicular to said side of said grip and an orientation of said projected line on said plane relative to said face of said head indicates an alignment of said grip relative to said face of said head;

and (d) mounting means for mounting said unit on said grip of said club.

* * * * *